United States Patent [19]

Tanji et al.

[11] 4,288,717

[45] Sep. 8, 1981

[54] THERMIONIC CATHODE APPARATUS

[75] Inventors: Hiroaki Tanji; Mitsuaki Saito; Masaji Ishii, all of Machidashi, Japan

[73] Assignee: Denki Kagaku Kogyo Kabushiki Kaisha, Machidashi, Japan

[21] Appl. No.: 91,860

[22] Filed: Nov. 6, 1979

[51] Int. Cl.[3] ..... H01J 1/16; H01J 19/10

[52] U.S. Cl. ..... 313/336; 313/311; 313/346 R

[58] Field of Search ..... 313/336, 337, 346, 237, 313/311

[56] References Cited

U.S. PATENT DOCUMENTS

| | | | |
|---|---|---|---|
| 3,532,923 | 10/1970 | Vogel | 313/336 X |
| 3,631,291 | 4/1969 | Faureau | 313/336 |
| 3,928,783 | 12/1975 | Hosoki et al. | 313/346 R |
| 4,068,145 | 1/1978 | Nakagawa et al. | 313/336 |
| 4,137,476 | 1/1979 | Ishii et al. | 313/346 R |
| 4,193,013 | 3/1980 | Futamoto et al. | 313/336 |

*Primary Examiner*—Saxfield Chatmon, Jr.
*Attorney, Agent, or Firm*—Sughrue, Rothwell, Mion, Zinn and Macpeak

[57] ABSTRACT

A thermionic cathode includes an electron emitting tip, lanthanum hexaboride tip supporting heaters in close contact with both sides of the tip and supporting the tip, and elastic electroconductive members in pressure contact with outer surfaces of the tip supporting heaters for supplying electric current. The tip supporting heaters are obtained by cutting lanthanum hexaboride having high anisotropy due to its layered structure so as to form a pair of parallel planes perpendicular to a pressing direction when hot-pressed, and abrade-polishing the parallel planes. The tip supporting heaters are brought into close contact with the tip and the elastic electroconductive members at the resulting smooth surfaces thereof. The apparatus of the invention has a prolonged lifetime and high efficiency.

3 Claims, 4 Drawing Figures

THERMIONIC CATHODE APPARATUS

BACKGROUND OF THE INVENTION

1. Field of the Invention

The present invention relates to a thermionic emission cathode using, as cathodes, materials of calcium hexaboride type such as lanthanum hexaboride for emitting electrons, and more particularly to a thermionic cathode using highly oriented (anisotropic) carbonaceous materials which tightly hold a cathode emission tip between suitable electroconductive members and at the same time supply thermal energy sufficient for emission of electrons as a heater.

The term "tip supporting heater" used hereafter refers to a member comprising such carbonaceous materials which supports or tightly holds the cathode emission tip between electroconductive members and concurrently heats the emission tip to working temperature 2. Brief Description of the Prior Art Rare earth borides, in particular lanthanum hexaboride, have properties which make it highly suitable as a cathode material. The characteristic which has prevented the wide-range use of lanthanum hexaboride as an emitter material is its highly reactive nature at high operating temperatures. Most supporting members will react with lanthanum hexaboride to cause deterioration of the supporting members. Therefore, the lifetime of such cathodes is disadvantageously short. In order to eliminate this disadvantage, various proposals have heretofore been made regarding thermionic structures of this type.

U.S. Pat. No. 4,054,946 discloses a cathode device which comprises holding a single crystal $LaB_6$ tip with two pieces of vitreous carbon and supporting the pieces by molybdenum jaws. However, vitreous carbon or glassy carbon materials are extremely rigid and prone to break into glassy fragments so that it is difficult to freely process them into a desired shape and size.

Further, U.S. Pat. No. 4,068,145 discloses a device comprising a heating member using pyrolytic graphite or boron carbide as a means for heating an emitter tip which is designed so as to nullify an undesired shift of the emitter due to thermal deformation by supporting the heating member with elastic electroconductive members. However, this device consumes a considerable amount of an electric power when the heater is in a heated condition and temperature changes are liable to occur even though a constant current is continuously supplied. Therefore, stability is not satisfactory. Furthermore, the device becomes unavoidably large in scale and thus it was impossible to apply this device to conventional tungstenmade hairpin cathode devices.

The present inventors have found a novel carbonaceous material such as lanthanum hexaboride which is chemically active at high working temperatures and suitable for supporting and simultaneously heating an emitter tip.

SUMMARY OF THE INVENTION

An object of the present invention is to provide a tip supporting heater suitable for tightly holding a thermionic emission tip in close contact with the heater which is active at working temperatures.

A further object of the present invention is to provide a cathode apparatus having high efficiency and a prolonged lifetime utilizing such a tip supporting heater.

BRIEF DESCRIPTION OF THE INVENTION

DETAILED DESCRIPTION OF THE INVENTION

Figure 1:
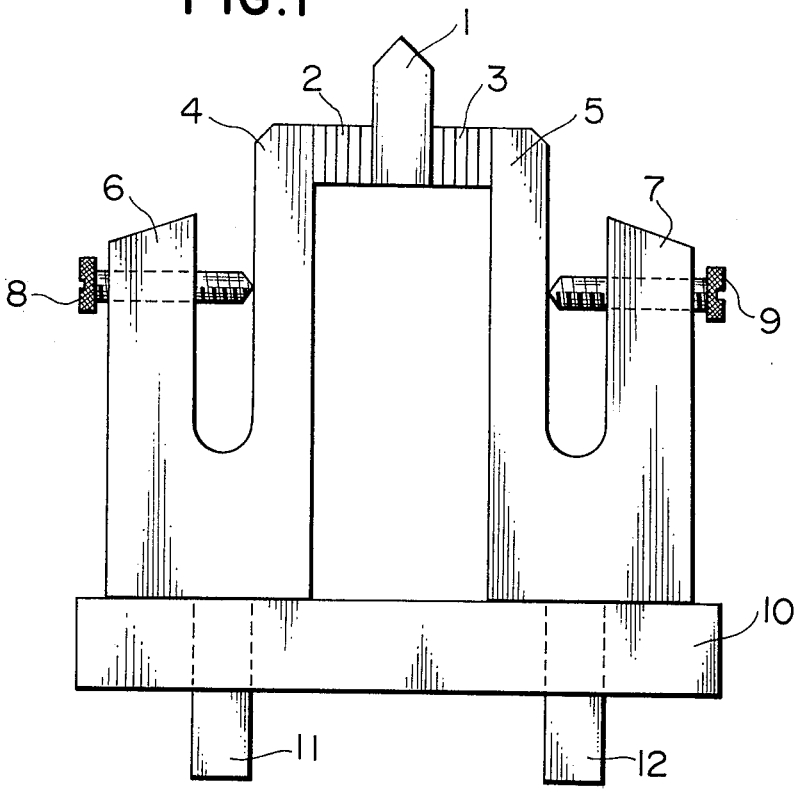
FIG. 1 is an elevational view of the apparatus in accordance with the present invention.

The carbonaceous material making up the cathode apparatus of the present invention has a layered structure and thus possesses anisotropy, and can relatively easily be prepared. Further in the case where this material is employed as a heater and supporter or holder of a cathode tip, there are advantages that emission current becomes constant with shortened time period, heating is effected in a small power consumption, and temperature after heating (i.e., working temperature) is stably maintained, etc., as compared to the prior art system using the aforesaid pyrolytic graphite, glassy carbon materials of vitreous carbon.

The tip supporting heater of the present invention can be prepared using a highly oriented carbonaceous molding having a layered structure. The molding is obtained by hot-pressing in a graphite die a solid molding of a resin (condensation product or polymer) such as acryl nitrile resin or the like, which does not melt under heating and is easily converted into graphite, under pressure of 100 to 500 kg/cm$^2$ at temperatures of 1600° to 3000° C. in a non-oxidizing atmosphere. The thus obtained molding has a layered structure in which a plane perpendicular to the c-axis of graphite microcrystals is extremely highly oriented in the direction perpendicular to the pressing direction. Thereafter, the hot press molding (ingot) is cut into a suitable size at the section perpendicular to the pressing direction to obtain a carbonaceous block. The carbonaceous block so obtained is generally in the form of a cube or rectangular prism. In such a case, the block is cut into small pieces in the direction perpendicular to the pressing direction of the aforesaid hot press and in the direction parallel to the pressing direction of the hot press.

Preparation Example

Furan resin commercially available was molded and hardened using aniline sulfate commercially available in a conventional manner to obtain a resin molding of 200 mm in diameter and 30 mm in length. This resin molding was charged into a graphite die of 700 mm in outer diameter, 200 mm in inner diameter and 700 mm height. While adding thereto a pressure of 200 kg/cm$^2$ in the longitudinal direction of the resin molding, the resin molding was heated to 2200° C. and kept at this temperature for 30 mins. Thereafter, the molding was cooled to obtain carbonaceous molding of a 200 mm in diameter and a thickness of about 6 mm. A cubic block of $50\times50\times50$ mm was cut out of the thus obtained carbonaceous molding in such a manner that a pair of planes facing each other were perpendicular to the pressing direction of the hot press. This block displayed a density of 2.10 g/cm$^3$ and a specific resistance of $5\times10^5$ $\mu\Omega$cm in the pressing direction and $3\times10^2$ $\mu\Omega$cm in the perpendicular direction and a thermal conductivity of $3\times10^{-3}$ C.G.S. in the pressing direction and $1\times10^{-1}$ C.G.S. in the perpendicular direction.

The cathode apparatus composed of the aforesaid highly oriented carbonaceous material as a heater will be described with reference to the drawings.

A reference numeral (1) denotes a lanthanum hexaboride cathode tip. Reference numerals (2) (3) each denote a tip supporting heater for tightly holding the tip in close contact with both sides of the tip and is positioned such that the side of the heater in close contact with the tip be perpendicular to the c-axis of graphite microcrystals, i.e., perpendicular to the pressing direction when hot-pressed. For this reason, the heater exhibits high resistance and low thermal when current flows in the pressing direction. Reference numerals (4) (5) denote elastic electroconductive supports imparting a holding or tightening force to the heater and the tip. The elastic electroconductive supports are fixed to a base (10) and connected with lead terminals (11) (12) penetrating into the base, respectively. The elastic support is formed into a forked shape at its base portion. Screws (8) (9) for controlling the pressing force are engaged through outer supports (6) (7). The end of the respective screws are brought into contact with the outer surface of the elastic supports (4) (5). The screws for controlling the pressing force are necessary for preventing the tip and heater from thermal deformation or thermal distortion upon heating and for keeping the location of the top of the tip at the right position.

The above cathode apparatus is connected to a constant current source. When the fixed current is applied to the cathode apparatus, the heaters are rapidly heated so that the tip is heated to, and maintained, at its working temperature.

Figure 2:
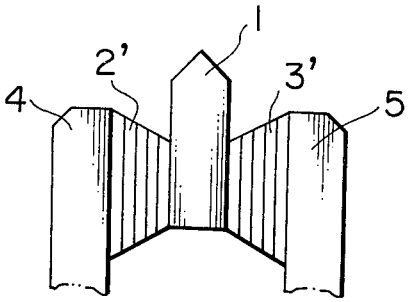
FIG. 2 is an elevational view of essential parts of the apparatus in accordance with the present invention.

The heater material used in the present invention can easily be cut and processed into a desired shape and size. If the tip supporting heaters are made into the shape of a truncated pyramid as shown in FIG. 2, the contact area with the tip can be reduced and the contact area with the elastic supports can be made relatively large. By doing so, undesirable heating of the elastic electroconductive supports can be prevented and the tip can be heated more stably.

The cathode of the present invention involves the following advantages; the heating power is less, the time period for elevating the temperature of the tip, i.e., the time period until the tip reaches its working temperature, is shortened, and chemical as well as physical stability is attained at high temperatures.

In order to demonstrate the effects achieved by the present invention was, the cathode device of the present invention mounted to a scanning electron microscope (SEM), and was compared with the cathode using highly anisotropic pyrolytic graphite, similarly mounted to a SEM. The results are shown in the table below.

TABLE 1

| Tip supporting heaters | Tip supporting heaters of this invention (A) | Pyrolytic graphite heaters (B) |
|---|---|---|
| Reactivity with tip | no reaction after operation for 1062 hours | Substances which might be reaction products appeared at the interface with the tip after operation for 300 hrs. (observed by an optical microscope) |
| Time until the top of the tip reached 1600° C. | 8 mins. | 21 mins. |
| Heating current (tip temp. 1600° C.) | 2.5 A | 2.7 A |
| Heating power(") | 7.9 W | 10.2 W |
| Temperature decrease (FIG. 3) | small | large |
| Stability of probe current (FIG. 4) | stable | unstable |

Figure 3:
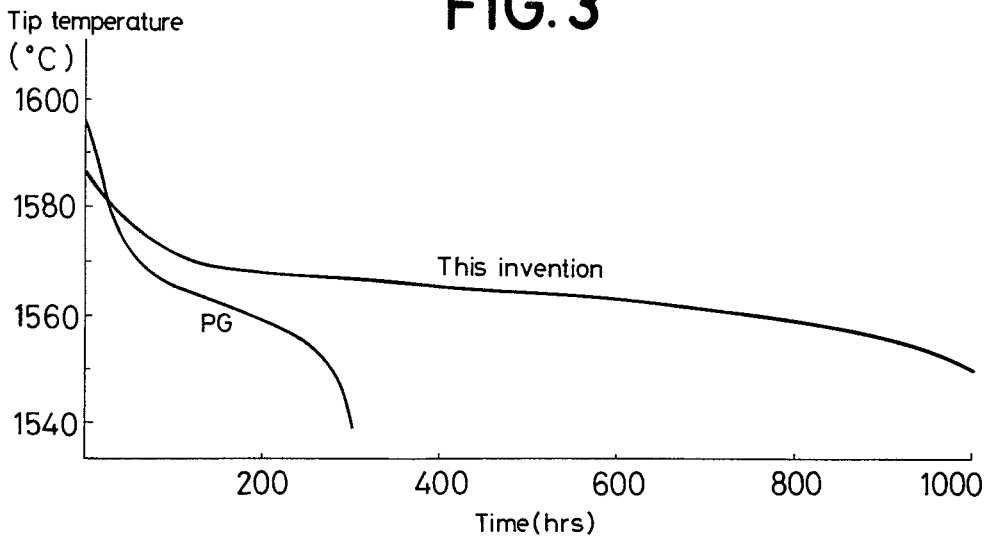
FIG. 3 is a graph showing temperature change of the tip with passage of time.
Figure 4:
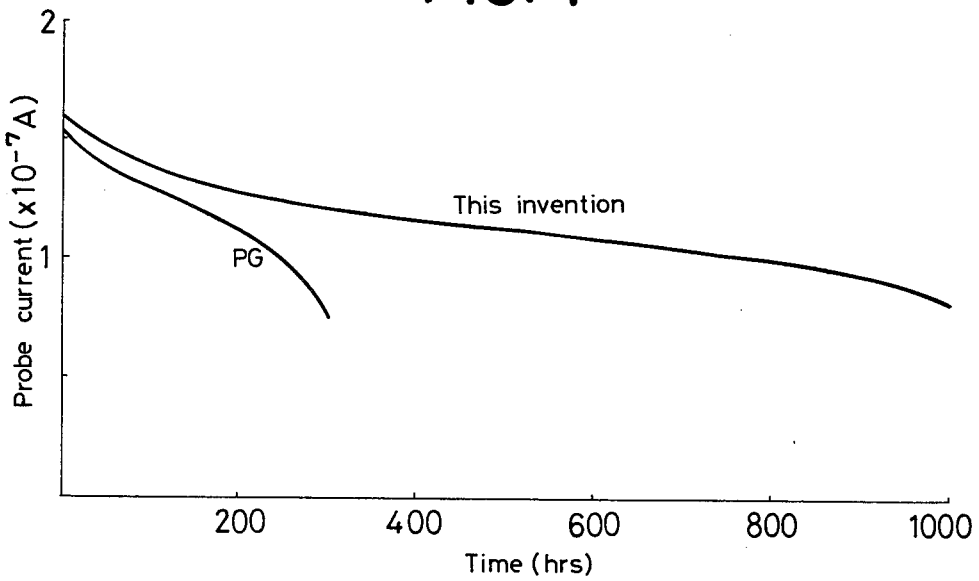
FIG. 4 is a graph showing change in probe current (measured with a Faraday cup).

FIGS. 3 and 4 show the results obtained by measuring probe current while observing the temperature of the tip.

In the system using pyrolytic graphite according to the prior art, the temperature was markedly decreased at an initial stage. In addition, lowering of temperature and decrease in probe current are remarkable with the passage of time. Accordingly, it was impossible to continue this test after 300 hours had elapsed. At the end of the test, the surface of the pyrolytic graphite heater was observed and reaction products were recognized on the tip. However, the tip supporting heater of the present invention could be stably used even after 1000 hours had elapsed. The pyrolytic graphite used in the above test was graphite obtained by heat treatment at 2000° C. (PG 2000). In general, it is known that pyrolytic graphite shows high anisotropy with high temperature heat treatment. However, the electric current required for heating the tip using PG 3200 (heat-treated at 3200° C.) at 1600° C. was 4.2 A and the power was 12.2 watts. This data indicates that the degree of anisotropy alone is not a decisive factor for preference as tip supporting heater materials. The reason why PG 2000 is superior to PG 3200 would be that PG 3200 has higher anisotrop because of the orientation property of crystal faces is larger than in PG 2000 but, on the other hand, graphitization is advanced with PG 3200 to reduce its resistance. Pyrolytic graphite subjected to heat treatment at lower temperatures contains a non-crystalline phase and thus provides poor anisotropy. Therefore, such pyrolytic graphite is not suitable for use of as a heater material. Considering the above, it is necessary that optimal temperatures for heat treatment be chosen in the case of using pyrolytic graphite as heater materials. In addition, pyrolytic graphite does not form completely parallel planes even if its surface is subjected to abrasion-finishing. In contrast, the completely smooth surface of the tip supporting heater of the present invention enables the supporting heater to completely be brought into contact with the tip. Therefore, the tip supporting heater of the present invention provides less change in contact resistance and thus less change in current. In addition, the tip supporting heater of the present invention enables the tip to stably and continuously emit electron beams of high quality over a long period of time. Accordingly, the present invention can provide the best apparatus as a cathode in the electron beam lithographic system which is indispensable for manufacturing VLSI.

While the invention has been described in detail and with reference to specific embodiments thereof, it will be apparent to one skilled in the art that various changes and modifications can be made therein without departing from the spirit and scope thereof.

What is claimed is:

1. A thermionic cathode comprising an electron emitting tip, tip supporting heaters made of a carbonaceous material arranged in contact with both sides of said tip, respectively, and supporting said tip, and elastic electroconductive members fixed to a base, said electroconductive members being arranged in pressure contact with the outer surfaces of said tip supporting heaters, and serving to supply an electric current thereto;

said tip supporting heaters being obtained by cutting said carbonaceous material, said carbonaceous material being obtained by hot-pressing a molding of synthetic resin that does not melt under heating, so as to form a pair of parallel planes perpendicular to the pressing direction, abrasion-polishing said parallel planes and then bringing the resulting smooth surfaces into close contact with said tip and said electroconductive members.

2. The thermionic cathode as claimed in claim 1 wherein said elastic electroconductive members are provided with screws for controlling the pressing force applied to the supporting heaters and the tip.

3. The thermionic cathode as claimed in claim 1 wherein said parallel planes of the tip supporting heaters are formed such that the area in contact with the elastic electroconductive members is large compared to the area in contact with the tip, such that the tip supporting heaters are formed in the shape of truncated pyramids.

* * * * *